US005865122A

United States Patent [19]

Hudson et al.

[11] Patent Number: 5,865,122

[45] Date of Patent: Feb. 2, 1999

[54] APPARATUS FOR ATTACHING BUFFER STOP TO RAILROAD TRACK

[75] Inventors: Richard C. Hudson, Auckley Doncaster, England; J. Joe Meyer, Williamsburg, Ind.

[73] Assignee: Western-Cullen-Hayes Inc., Chicago, Ill.

[21] Appl. No.: 880,083

[22] Filed: Jun. 20, 1997

[51] Int. Cl.[6] ..... B61K 7/18

[52] U.S. Cl. ..... 104/259; 104/258; 188/62; 411/368

[58] Field of Search ..... 104/257, 258, 104/259, 260; 188/62; 411/6, 347, 368

[56] References Cited

U.S. PATENT DOCUMENTS

| | | | |
|---|---|---|---|
| 993,031 | 5/1911 | Coleman | 188/250 G |
| 1,472,405 | 10/1923 | Amberton | 411/368 |
| 1,707,196 | 3/1929 | Taylor | 104/257 |
| 2,253,829 | 8/1941 | Werner | 104/257 |
| 2,942,557 | 6/1960 | Hirsch et al. | 104/259 |
| 3,596,944 | 8/1971 | Ecker et al. | 403/16 |
| 5,211,266 | 5/1993 | Meyer . | |

FOREIGN PATENT DOCUMENTS

| | | | |
|---|---|---|---|
| 1108863 | 4/1968 | United Kingdom | 104/259 |
| 9626855 | 6/1996 | WIPO . | |
| 9626856 | 6/1996 | WIPO . | |

OTHER PUBLICATIONS

Product Data Sheet from Balfour Beatty Railway Engineering Limited; Modular Sliding Buffer Stop Revision B, not dated.

"Rawie" advertisement in Railway Gazette International, Jun. 1996.

*Primary Examiner*—S. Joseph Morano
*Attorney, Agent, or Firm*—Banner & Witcoff, Ltd

[57] ABSTRACT

A shoe or clamp assembly for securing a buffer stop or bumping post to railroad track with a predetermined magnitude of retardation against sliding movement of the buffer stop when the same is engaged by a moving railcar to be stopped. The shoe assembly which clamps against opposite sides of a buffer stop wall, and also clamps against opposite sides of a rail, is secured by at least one bolt and nut and also a spring stack so that a torque wrench is not required in order to effect such securement.

16 Claims, 4 Drawing Sheets

APPARATUS FOR ATTACHING BUFFER STOP TO RAILROAD TRACK

BACKGROUND OF THE INVENTION

The present invention relates to apparatus for attaching a buffer stop or bumping post to railroad track. It has been known for a long time to provide a bumping post or buffer stop at the end of a length of railroad track for serving as an emergency stop in the event a train or railroad car fails to stop in the intended manner due to mistake or equipment failure.

The known buffer stops may be of the type which are intended to slide along a track after being engaged by a railcar, or of the type which are intended to resist the impact of a moving railcar which engages the buffer stop without sliding along the track. In applications of the sliding buffer type, which are most often used in Europe, a sufficient length of extra track is provided to accommodate sliding movement of the buffer from its fixed position. In applications where such extra track is not available, which is often the case in the United States, the buffer stop is attached to rail track with the intent that it will remain in a fixed position when engaged by a moving railcar.

It is also known to provide one or more slave units which are mounted behind a buffer stop in spaced relation thereto so when a buffer stop is caused to slide along track due to the impact of a moving railcar, it will be moved into engagement with an adjacent slave unit which will also slide along the track and assist the buffer stop in stopping a moving railcar.

The present invention does not involve a novel buffer stop. Instead, it relates to novel mechanism for attaching a buffer stop to railroad track. Such novel attachment mechanism has application whether it is intended that the buffer stop will be of the sliding type, or whether the buffer stop is intended to remain fixed when impacted by a moving railcar.

It is also known to provide apparatus for attaching a buffer stop to railroad track. Such known apparatus includes a pair of shoes which at their lower ends engage opposite sides of a rail and upper ends which are bolted together and clamped on opposite sides of a bumping post or buffer stop side wall. In the foregoing manner, a bumping post is attached to the opposed pair of shoes, and the shoes are held by friction to the rail, so that the bumping post is attached to the rail. As noted above, such attachment may be intended to permit the bumping post to slide along the rail on impact from a moving railcar, or it may be intended to hold the bumping post fixed on the rail when impacted by a moving railcar to be stopped.

Still referring to known apparatus for securing a bumping post or buffer stop to rail track, such apparatus includes a pair of opposed shoes which are mounted on opposite sides of a buffer stop side wall, with their lower ends engaged firmly against opposite sides of a rail, and bolts are used to tighten the shoes against the opposite sides of the buffer stop side wall while at the same time tightening the lower ends of the shoes against the rail to obtain a predetermined tightness against the rail. The prior art teaches the use of a torque wrench which measures torque for tightening the bolts referred to above. It is common to provide three bolts for tightening each pair of opposed shoes to secure a buffer stop to a rail. It is also common to provide a plurality such as three sets of shoes for attaching each side wall of a buffer stop to a corresponding rail.

In the foregoing example, if three sets of opposed shoes are provided for each side of a buffer stop, and if three bolts are provided to attach each pair of shoes, nine bolts per side will be required or a total of 18 bolts to attach a buffer stop to rail. The number of bolts is important because it determines the time and effort required to attach a buffer stop to a rail. In this respect, it should be noted that when a sliding buffer has been caused to slide from its normal position due to impact from a moving railcar, it must be repositioned in its original location which requires using the usual torque wrench to properly retighten each of the bolts after loosening the same and repositioning the buffer stop.

One feature of the present invention eliminates the need for using torque wrenches by providing a novel spring pack associated with each of the bolts which tighten a pair of shoes against an opposite side of a buffer side wall. The foregoing feature permits an operator to tighten the bolts to a predetermined tightness with more accuracy and with less time and effort than when the known torque wrenches are used to obtain a predetermined tightness.

Another feature of the present invention comprises a pair of longitudinal wear strips which are riveted to each of a pair of opposing shoes at the inside lower ends thereof which shoes engage against a rail along spaced longitudinal strips thereof. Thus, the tighter the bolts are tightened to clamp a pair of opposed shoes against the opposite sides of a bumper stop side wall, the tighter will be the engagement between the lower ends of such shoes and the rail. In such applications, the shoes will engage the rail only by means of the longitudinal wear strips attached to each shoe. Such wear strips are preferably made of bronze or other metal dissimilar to the rail, and they may be replaced when undue wear occurs.

The foregoing and other objects and advantages of the invention will be apparent from the following description of a preferred embodiment thereof, taken in conjunction with the accompanying drawings.

Now, in order to acquaint those skilled in the art with the manner of making and using our invention, we shall describe, in conjunction with the accompanying drawings, a preferred embodiment of the invention.

DETAILED DESCRIPTION OF THE INVENTION

Figure 1:
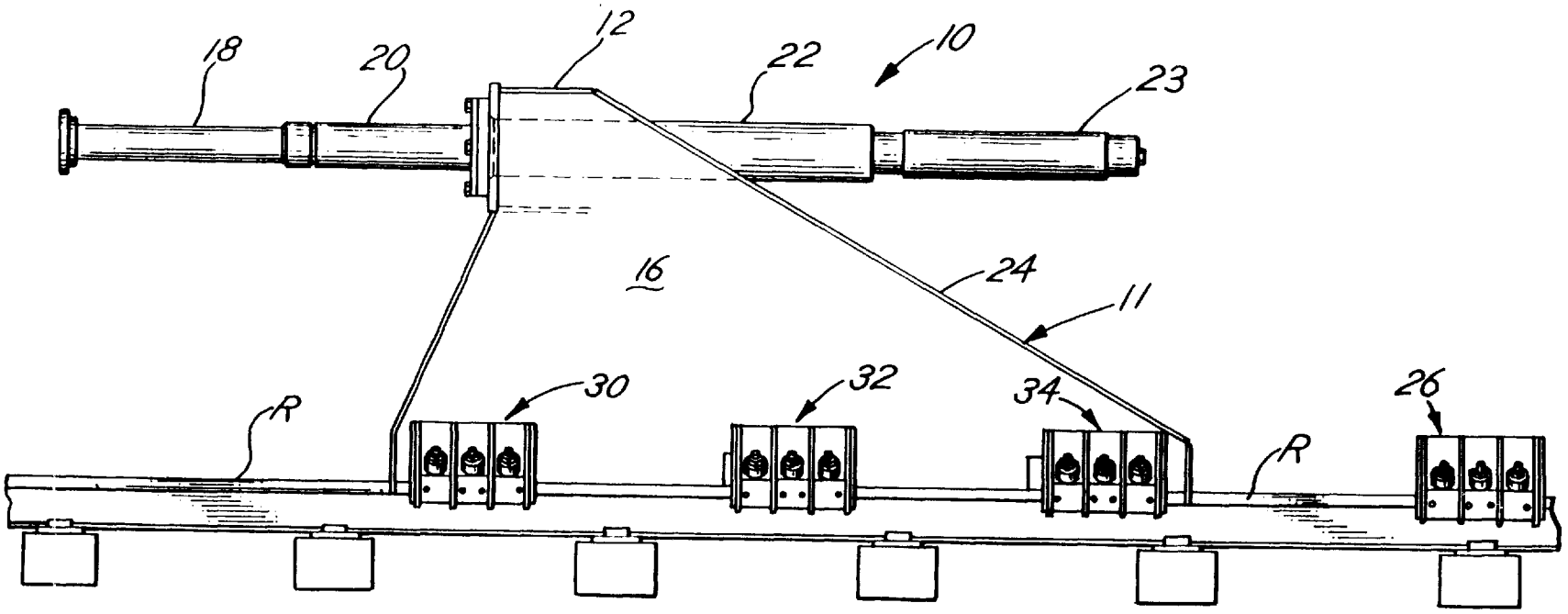
FIG. 1 is a side elevational view showing a known buffer stop attached to a length of rail by attachment apparatus in accordance with the present invention, there being shown three sets of opposed shoes at one side of a buffer side wall, and also a separate slave unit to be engaged by the rear end of the buffer stop when the same is caused to slide from its normal position.
Figure 2:
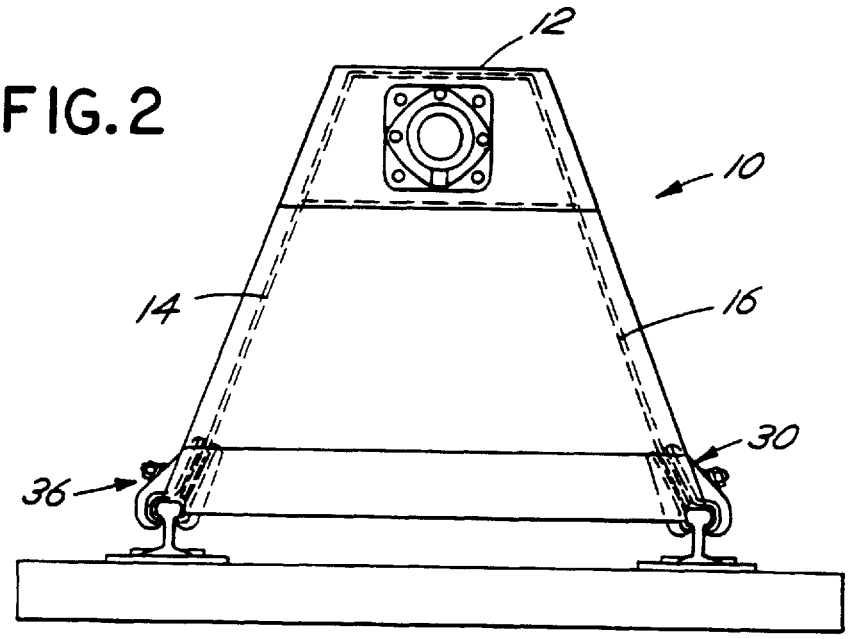
FIG. 2 is an end elevational view of the buffer stop of FIG. 1 showing the manner in which opposed sets of shoes secure the buffer stop to a rail by bolts which are tightened to clamp the opposed shoes against a side wall of the buffer stop and also against opposite sides of the rail.
Figure 4:
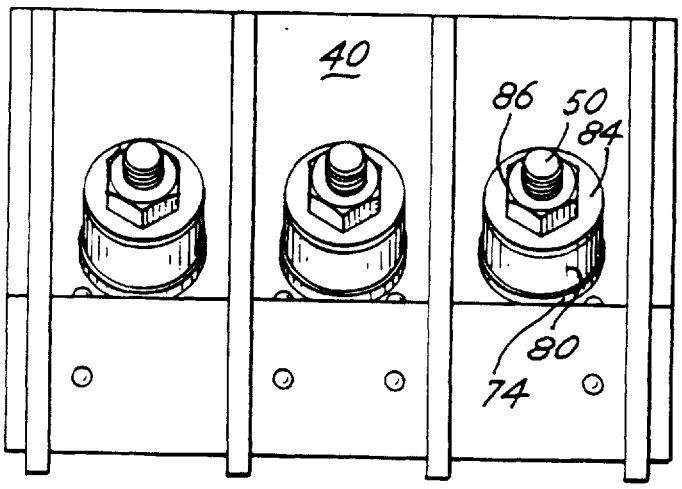
FIG. 4 is a side elevational view looking in the direction of the arrows 4—4 of FIG. 3.

FIGS. 1 and 2 show a known buffer stop 10 including a frame 11 having a top wall 12 and opposed, slanted side walls 14 and 16. The buffer stop includes a hydraulic unit comprising a cylinder 18 which is slidable into a cylinder 20 which in turn is slidable into a fixed cylinder 22. The member shown at 23 is also fixed. FIG. 2 is an end elevational view which faces the left end of the buffer stop as viewed in FIG. 1. The top wall 12 merges with a relatively long slanted wall 24 which connects with the side walls 14 and 16.

The buffer stop 10 is of the type designed to slide to the right as viewed in FIG. 1 when a moving railcar engages against the end of the member 18. The member 18 is intended to telescope into member 20 which in turn telescopes into fixed member 22, the member 23 also being fixed. As the telescoping operation is completed, or substantially completed, the force applied to the frame 11 may cause the buffer stop to slide along the rail into engagement with a slave unit shown at 26 in FIG. 1.

There are various types of known buffer stops in addition to the one shown in FIGS. 1 and 2. Some such buffer stops may not have hydraulic telescoping cylinders as shown in FIG. 1, and others may be mounted in conjunction with a plurality of slave units of the type shown at 26 in FIG. 1. Still others are designed to remain fixed on the rail when they are engaged by a moving rail car to be stopped. The apparatus for securing a buffer stop to a length of rail, which is the subject of the present invention, may be used with any of the known types of buffer stops, and thus the buffer stop shown at 10 in FIGS. 1 and 2 is illustrated only by way of example.

FIG. 1 shows three sets of clamp assemblies indicated generally at 30, 32 and 34 for securing the buffer stop to the rail. Three additional sets of clamp assemblies which cooperate with the opposite buffer side wall 14 are also provided, one such assembly being shown at 36 in FIG. 2. A total of six clamp assemblies are provided, three for each buffer side wall 14 and 16, for securing the buffer stop 10 to a pair of rails. However, the number of attachment devices provided for each buffer side wall may vary.

Figure 5:
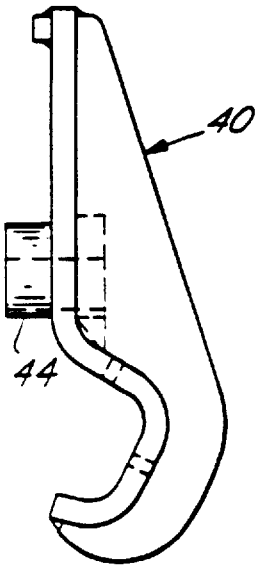
FIG. 5 is an end elevational view of one of a pair of shoes.
Figure 6:
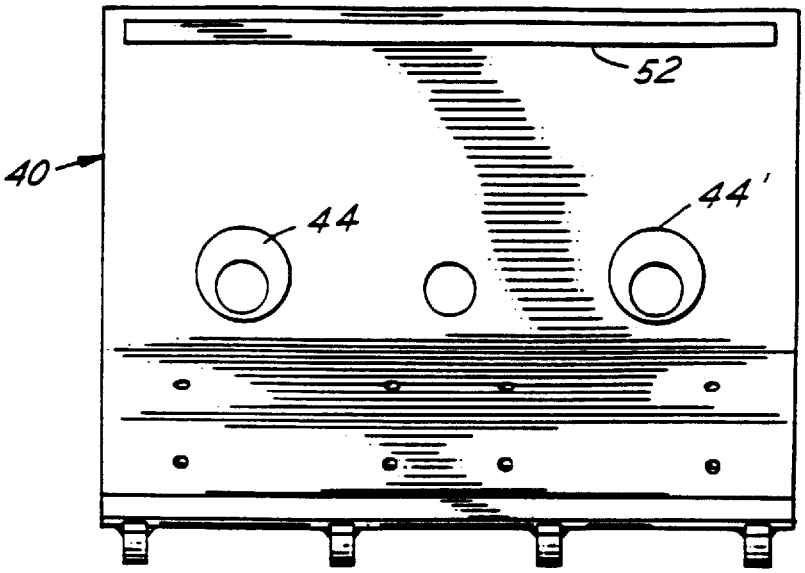
FIG. 6 is a side elevational view of the shoe of FIG. 5.
Figure 7:
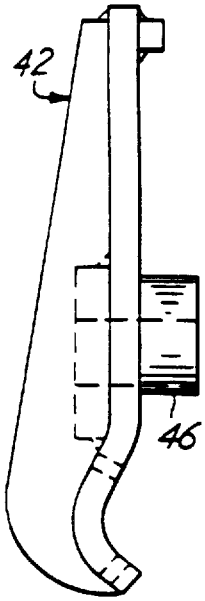
FIG. 7 is an end elevational view of a second one of a pair of shoes.
Figure 8:
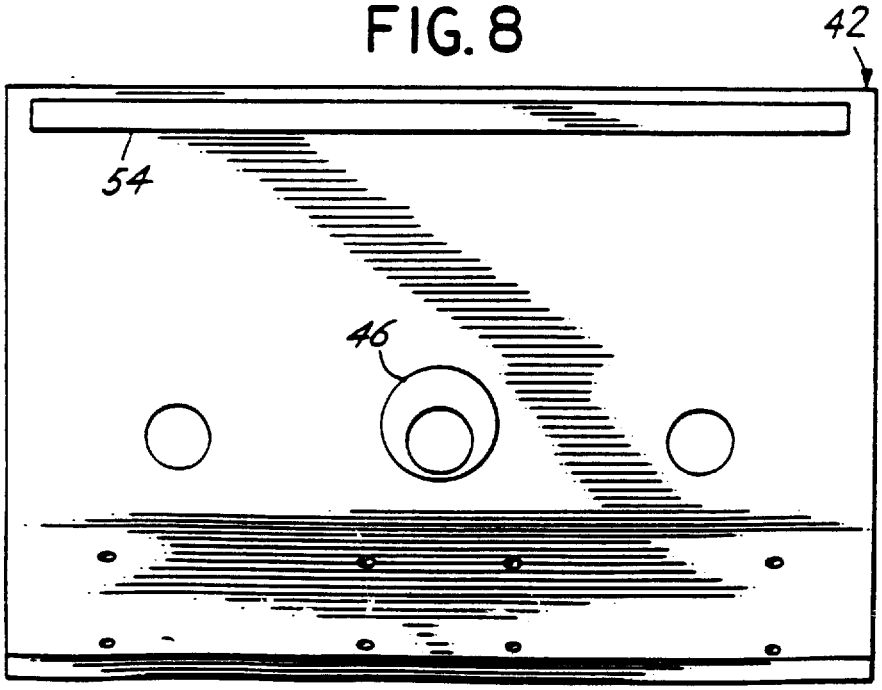
FIG. 8 is a side elevational view of the shoe of FIG. 7.

Each of the clamp assemblies 30, 32, 34, 36, etc. are the same, so only one such assembly will be described. Each such assembly includes a pair of shoes which are clamped on opposite sides of a corresponding buffer side wall 14 or 16. FIGS. 5 and 6 show one of the shoes 40 which is the right-hand shoe shown in FIG. 3. FIGS. 7 and 8 show the opposite shoe 42 which is the left-hand shoe shown in FIG. 3.

FIG. 5 shows a round boss 44 formed integral with the shoe 40, and FIG. 7 shows a similar round boss 46 formed integral on the shoe 42. The shoes 40 and 42 are designed so that taken together they have three spaced integral bosses which project into similarly sized openings in a corresponding buffer side wall 14 or 16. FIG. 6 shows that the shoe 40 has two such bosses 44 and 44', and FIG. 8 shows that the shoe 42 has one such boss 46. The use of such bosses which fit closely into corresponding openings in a buffer side wall is known in the art and serves the purpose of providing a rigid longitudinal connection between the shoes and a buffer side wall and also so that longitudinal forces will not tend to shear the bolts which clamp the shoes against opposite sides of a buffer side wall.

In the embodiment being described, there are three bolts 50 provided for each of the clamp assemblies, and thus three spaced bolt holes are provided in each of the shoes 40 and 42. The bolt holes are aligned with the guides or bosses 44 and 46 and, as noted above, when a pair of the shoes is clamped on opposite sides of a buffer side wall as shown in FIG. 3, the shoes are longitudinally locked to the buffer side wall.

Figure 3:
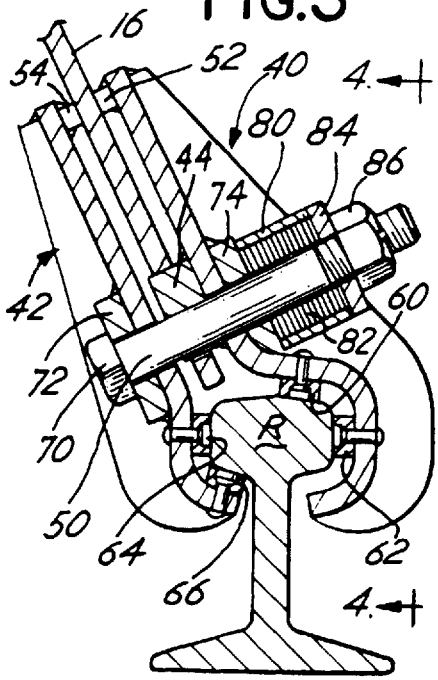
FIG. 3 is an enlarged, end elevational view, partly broken away, showing the manner in which two opposed shoes are clamped against opposite sides of a buffer side wall and against a rail by use of attachment apparatus in accordance with the present invention.

FIG. 3 shows the buffer stop side wall 16 (see also FIG. 2) and it shows the shoes 40 and 42 held tightly clamped against opposite sides of that wall. The shoe 40 has a long contact strip 52 which extends the length of the shoe (see FIG. 6) and is welded thereto so that strip 52 contacts side wall 16. In a similar manner, the shoe 42 has a long contact strip 54 which extends the length of the shoe (see FIG. 8) and is welded thereto so that strip 54 contacts side wall 16. As shown in FIG. 3, the only contact between the shoes 40 and 42 and side wall 16 is where the contact strips 52 and 54 engage the side wall at the upper end of the shoes.

Figure 9:
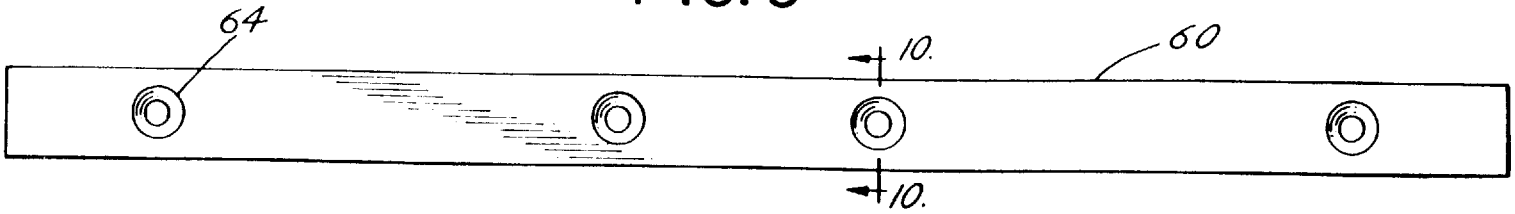
FIG. 9 is a side elevational view of one of a plurality of wear strips which are riveted to the shoes for engagement against a rail.
Figure 10:
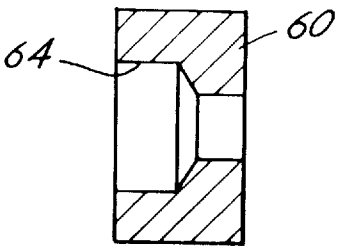
FIG. 10 is a cross-section taken along the line 10—10 of FIG. 9.

Still referring to FIG. 3, the shoe 40 has a pair of longitudinal wear strips 60 and 62 riveted to the lower inside wall of the shoe so that such wear strips engage against the rail R at selected locations. In a similar manner, the shoe 42 has a pair of longitudinal wear strips 64 and 66 riveted to the lower inside wall of the shoe so that such wear strips engage against the rail R at selected locations generally on the opposite side of the rail. Each of the four wear strips extends approximately the full length of the shoes 40 and 42. The four wear strips may be identical to one another and FIGS. 9 and 10 show one of the wear strips 60 which is provided with four drilled holes 64 for rivets which are used to attach the wear strips to the shoes.

FIG. 3 further shows the bolt 50 having an integral head portion 70 at the lower left end thereof, the bolt head 70 being abutted against a boss 72 which is welded to the side of the buffer stop side wall 16. The bolt 50 passes through a hole in the boss 72 and a hole in the shoe 42, and it then passes through the previously described boss 44 formed integral on the shoe 40 (see FIG. 6).

The bolt 50 further extends through the opposing shoe 40 and through a boss 74 which is welded to the outside of shoe 40. FIG. 3 further shows a spring pack which includes a metal tube 80 engaged against boss 74, a plurality of Belleville washers 82 contained in tube 80, a washer 84 positioned on the outer end of tube 80, and a nut 86 threaded on the end of bolt 50 by an amount sufficient to hold washer 84 against the end of the tube 80 thereby maintaining the stack of Belleville washers 82 compressed within the length of the tube.

Prior to the threading of nut 86 to the fully tightened position shown in FIG. 3, the stack of Belleville washers 82 is designed to extend well beyond the length of tube 80 in its non-compressed position. As the nut 86 is threaded down on the end of bolt 50 for the purpose of clamping the shoes 40 and 42 against opposite sides of the bumping post side wall 16, causing the four wear strips 60, 62, 64 and 66 to engage firmly against rail R, the Belleville washers 82 are compressed within tube 80, and in accordance with the intended procedure, an operator ceases to tighten nut 86 further once washer 84 engages against the end of tube 80.

The spring pack as described above has important advantages over the prior art use of torque wrenches for developing the desired clamping force on the opposed shoes 40 and 42 which determines the force of engagement between wear strips 60, 62 64 and 66 against rail R. The use of the spring pack shown in FIG. 3 determines the tension in the bolt 50 far more accurately than the use of a torque wrench. A torque wrench only monitors the force required to turn the nut, independently of the tension produced.

Also, as noted above, a bumper stop must be repositioned from time to time after protracted service, especially when the bumper has been caused to slide along the rail R due to impact by a moving railroad car, and the need to use a torque wrench to reset all of the bolts is far more difficult and less accurate than when the spring packs of the present invention are used. After protracted service, the bolts may be sufficiently corroded as to produce drastically reduced tension in the bolts when they are tightened to develop a predetermined torque by a torque wrench. Also, if the bolts are accidentally replaced by bolts with a finer thread pitch, the normal torque setting will produce an undesired greater tension in the bolt. All such errors in the bolt tension could have catastrophic results.

The spring stack may be varied in its configuration in order to vary the desired tension on the bolt 50 which controls the force between the wear strips 60, 62, 64 and 66 and rail R, which in turn controls the tightness by which the bumper stop side wall 16 is secured to rail R to resist sliding movement relative thereto. Thus, if one increases the strength of the Belleville washers 82 to resist compression, or increases the uncompressed length of the stack of Belleville washers, or if one reduces the length of tube 80, the result will be that upon threading of the nut 86 down to engagement with tube 80, a greater tension will be produced in bolt 50 so that bumper stop 10 will be more tightly secured to rail R. In addition to varying the design of the spring pack, one may vary the number of clamp assemblies from the three such assemblies shown in FIG. 1. Also, the number of slave units as shown at 26 in FIG. 1 may be varied.

In each application, one must design the spring stacks and the other variables discussed above to achieve the desired retardation characteristics concerning securement of the bumping post or bumper stop 10 of FIG. 1 to rail R. In many applications, bumping post 10 will be expected to slide upon impact by a moving railcar to be stopped, although in certain applications, especially in the United States, the attachment units or clamp assemblies may be designed, in conjunction with the telescoping cylinders shown at 18 and 20 on FIG. 1, so that most or all of the energy will be absorbed without the bumping post being caused to slide along the track.

Still referring to FIG. 3, the upper end of shoe 40 engages the side wall 16 of the bumping post only along the longitudinal strip where the elongated contact member 52 engages side wall 16. At the lower end of the shoe 40, the shoe engages the rail R only through wear strips 60 and 62. Thus, as one threads the nut 86 down on the threaded end of bolt 50, shoe 40 makes engagement with the bumper post only in one place at its upper end and against the rail R at its lower end. The force applied by tension in bolt 50 is taken out only through the engagement between the upper end of the shoe and the wall 16 and through the lower end of the shoe against rail R, and in no other place. Accordingly, the tension produced in bolt 50 determines the degree of retardation against sliding movement of the bumper stop 10 along rail R when the bumper stop is engaged by a moving rail car to be stopped.

By using a flat rate spring stack, it is possible to achieve reduced brake fade which is an advantage of the spring stack. It is also possible to achieve repeatability of brake forces independent of bolt tightening torque variations as when torque wrenches are used. The spring stack of the present invention provides brake force variability to suit any configuration of train weight by choice of the spring stack design. Also, no special tools such as torque wrenches are required. An operator need only tighten a nut 86 until tube 80 is lightly nipped by washer 84, at which time tightening is stopped. There is no inherent inaccuracy in bolt tension due to variations in bolt/nut friction as when torque wrenches are used to calibrate the tension in bolts 50.

In accordance with the present invention, while the use of Belleville washers is the preferred embodiment, one may also utilize coil springs, leaf springs, gas springs or resilient members manufactured from rubber or other elastomers. For some light duty applications, the nipping force could even be produced by gravity using balance weights. The shoes 40 and 42 could also be designed with a scissor action, with a central pivot, incorporating the spring stack at one end and the wear strips at the other.

Figure 11:
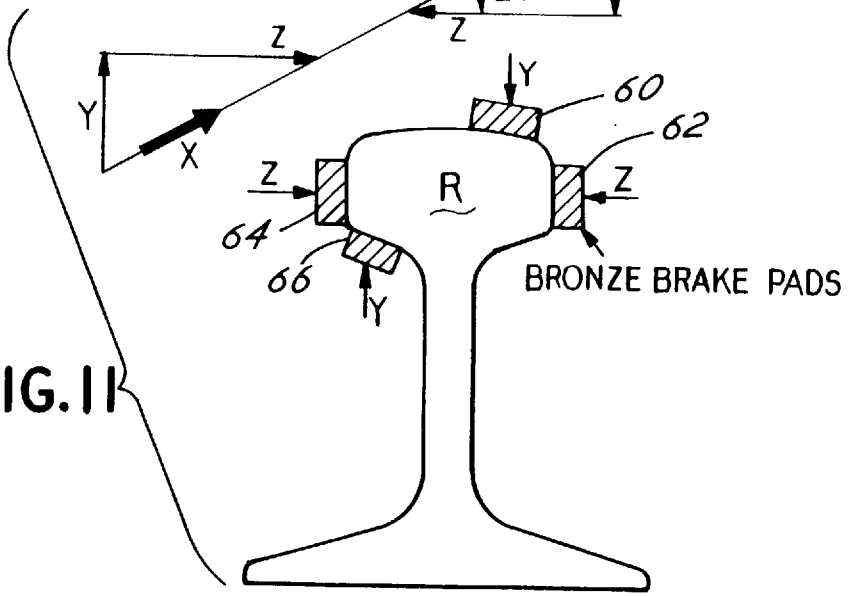
FIG. 11 is a diagrammatic cross-sectional view showing the approximate location of four wear strips which engage a rail along the length of a corresponding pair of shoes which are clamped to opposite sides of a buffer stop side wall.

FIG. 11 is a diagrammatic sketch which shows the areas where the wear strips or brake pads 60, 62, 64 and 66 engage rail R, and the figure shows the approximate direction of the forces applied to the rail by such wear strips.

Reference is again made to the wear strips shown at 60, 62, 64 and 66 in FIG. 3, and in particular to the closest prior art known to applicants. In one prior art buffer stop known as the Balfour Beatty design, bronze metal is sprayed onto the inside of the shoe members where they engage the rail. There are no separate wear strips fastened to the shoes. In another prior art design manufactured by A. Rawie GmvH & Co. of Osnabruck, Germany, a single wear strip is attached to the inside of each shoe where it contacts the rail, and such wear strip is cast to have the shape of the rail. It is believed it can be replaced when worn.

The present design comprising at least two wear strips having a simple rectangular shape which are attached to each of the shoes offers significant advantages over the known Rawie design. The rectangular wear strips, as best shown in FIGS. 9 and 10, are easy to manufacture and easily riveted to the shoes. If a wear strip is worn, it is not necessary to replace more than that one strip. The wear strips shown in FIGS. 9 and 10 are less expensive to manufacture, and it is believed they will offer greater durability than the Rawie design.

As is known, in the United States it is common to provide a bumping post or bumper stop as shown in FIG. 1 where a railcar will engage against the end of cylinder 18. Such U.S. railcars normally have one central coupler which will engage the end of cylinder 18. In Europe, it is more common for a railcar to have a pair of laterally spaced buffers, rather than a single, central coupler. In such cases, the buffer stop will include a pair of laterally spaced cylinders to be engaged by the pair of buffers. The present invention is designed for use with either of the foregoing types of buffer stops.

What is claimed is:

1. A shoe assembly for securing a buffer stop to a rail including a pair of shoes, the improvement comprising, in combination, a bolt and a nut arranged for drawing said pair of shoes into clamped relation, a spring container mounted over a projecting end of said bolt between said nut and one of said shoes, washer means positioned between said nut and said spring container and overlying an end of said spring container, and compressible spring means housed within said spring container and compressed by said washer means against said one of said shoes when said nut is threaded down on said bolt to a position where said nut forces said washer means into engagement with said spring container to fully compress said spring means and thus define a clamped position, whereby said spring container and said spring means provide a predetermined tension in said bolt when said nut is threaded to said clamped position.

2. A shoe assembly as defined in claim 1 where said spring means comprises a stack of Belleville washers.

3. A shoe assembly as defined in claim 1 where said spring container comprises a rigid tubular member open at both ends.

4. A shoe assembly as defined in claim 3 where said washer means comprises a washer having an outer diameter approximately equal to an outer diameter of said tubular member.

5. A shoe assembly for securing a buffer stop to a rail including a pair of shoes, the improvement comprising, in combination, a bolt and a nut arranged for drawing said pair of shoes into clamped relation, a spring container comprising metal tube means open at both ends and mounted over said bolt between said nut and one of said shoes, washer means positioned between said nut and said metal tube means and overlying an end of said tube means, and a stack of Belleville washers housed within said metal tube means and compressed within the length thereof by said washer means against said one of said shoes when said nut is threaded down on said bolt to a position where said nut forces said washer means into engagement with said metal tube means to compress said stack of Belleville washers within said length of said metal tube means and thus define a clamped position, whereby said metal tube means and said stack of Belleville washers provide a predetermined tension in said bolt when said nut is threaded to said clamped position.

6. A shoe assembly as defined in claim 1 where each of said shoes has a pair of spaced longitudinal wear strips fastened to its inside lower end.

7. A shoe assembly as defined in claim 6 wherein the longitudinal wear strips are removably riveted to said shoes.

8. A shoe assembly as defined in claim 6 where each of said wear strips comprises an elongated metal bar having a rectangular cross-section.

9. A shoe assembly as defined in claim 5 where each of said shoes has a pair of spaced longitudinal wear strips removably riveted to its inside lower end, each said wear strip comprises an elongated metal bar having a rectangular cross-section.

10. A shoe assembly for securing a buffer stop to a rail, the shoe assembly comprising:

a pair of shoes adapted to engage portions of the rail;

an adjustable length fastener cooperating with the shoes for applying a clamping force therebetween;

a resilient member for transmitting at least a portion of the clamping force from the adjustable length fastener to at least one of the shoes; and a stop member for limiting adjustment of the fastener to a predetermined length, the resilient member providing a predetermined clamping force when the fastener engages the stop member.

11. The shoe assembly according to claim 10, wherein the adjustable length fastener comprises a nut and bolt.

12. The shoe assembly according to claim 11, wherein the resilient member comprises a pack of Belleville springs disposed around the bolt.

13. The shoe assembly according to claim 12, further comprising a washer cooperatively associated with the nut and bolt, wherein the stop member is comprised of a spring container in the form of a tube having an end adapted to engage the washer.

14. The shoe assembly of claim 10, further comprising a pair of longitudinal wear strips on each shoe.

15. The shoe assembly of claim 14, wherein each shoe has a length, the longitudinal wear strips extending substantially continuously the length of a respective one of the shoes.

16. The shoe assembly of claim 15, wherein the longitudinal wear strips are rectangular in cross-section.

* * * * *